US008526869B2

(12) United States Patent
Shinkawa et al.

(10) Patent No.: US 8,526,869 B2
(45) Date of Patent: Sep. 3, 2013

(54) FIXING DEVICE AND IMAGE FORMING APPARATUS PROVIDED WITH SAME

(75) Inventors: Tatsuya Shinkawa, Osaka (JP); Atsushi Ide, Osaka (JP); Yoshinobu Tateishi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 236 days.

(21) Appl. No.: 13/013,135

(22) Filed: Jan. 25, 2011

(65) Prior Publication Data

US 2011/0188905 A1 Aug. 4, 2011

(30) Foreign Application Priority Data

Jan. 29, 2010 (JP) ..... 2010-018806

(51) Int. Cl.
*G03G 15/20* (2006.01)

(52) U.S. Cl.
USPC ..... 399/323; 399/398; 399/399; 271/307; 271/308; 271/311; 271/900

(58) Field of Classification Search
USPC ..... 399/323, 398, 399; 271/307, 308, 271/311, 900
See application file for complete search history.

(56) References Cited

U.S. PATENT DOCUMENTS

| | | | | |
|---|---|---|---|---|
| 3,992,000 | A * | 11/1976 | Martin | 399/323 |
| 6,259,881 | B1 * | 7/2001 | Nakamura | 399/323 |
| 6,658,229 | B2 | 12/2003 | Ando et al. | |
| 2003/0165348 | A1 * | 9/2003 | Amita et al. | 399/323 |
| 2006/0275060 | A1 | 12/2006 | Park | |

FOREIGN PATENT DOCUMENTS

| | | | |
|---|---|---|---|
| JP | 61-086343 | A | 5/1986 |
| JP | 02079879 | A * | 3/1990 |
| JP | 2001-240284 | | 9/2001 |
| JP | 2002-014565 | | 1/2002 |

* cited by examiner

*Primary Examiner* — Ryan Walsh
(74) *Attorney, Agent, or Firm* — Nixon & Vanderhye P.C.

(57) ABSTRACT

A fixing device is provided with a fixing roller, a peeling claw that peels a recording paper from the fixing roller, a peeling claw holder that rotatably supports the peeling claw, and a support member that movably supports the peeling claw holder to enable the peeling claw to retract by moving apart from the fixing roller, wherein not less than two directions are set as retracting directions of the peeling claw holder to be moved when the peeling claw is caused to retract by moving apart from the fixing roller.

3 Claims, 8 Drawing Sheets

FIXING DEVICE AND IMAGE FORMING APPARATUS PROVIDED WITH SAME

CROSS-REFERENCE TO RELATED APPLICATIONS

This application claims priority under 35 U.S.C. §119(a) on Patent Application No. 2010-018806 filed in Japan on Jan. 29, 2010, the entire contents of which are herein incorporated by reference.

BACKGROUND OF THE INVENTION

The present invention relates to fixing devices that fix toner images formed on paper, and to image forming apparatuses including the same.

This type of fixing device is applied in image forming apparatuses that use methods such as electrography, electrostatic recording, and magnetography or the like, and sandwich between a pair of fixing rollers a paper (such as plain paper, electrostatic recording paper, and photographic papers or the like) on which a toner image has been formed, thereby applying heat and pressure to fix the toner image onto the paper.

In these fixing devices, the paper sometimes winds around the fixing roller, and therefore the tip of a peeling claw is kept in contact with the fixing roller such that any paper that has wound around the fixing roller is peeled off by this peeling claw.

However, when a paper blockage (jam) occurs in the vicinity of the peeling claw of the fixing roller and transport of the paper stacks up, the paper sometimes strongly pushes the peeling claw against the surface of the fixing roller, thereby damaging the surface of the fixing roller or damaging the peeling claw.

For this reason, in JP 2002-14565A and JP 2002-145503A, a holder of the peeling claw (separation claw) is movably supported along a groove, and when the holder is pressed by the paper during a jam, the holder moves along the groove such that the separation claw retracts by moving apart from the fixing roller.

However, in both JP 2002-14565A and JP 2002-145503A, the movement trajectory of the holder when the separation claw holder moves along the groove is on a single line, and the movement direction of the holder is prescribed to a single direction, and therefore sometimes the tip of the separation claw cannot retract when the holder or the separation claw is being pressed by the jammed paper, and at this time the tip of the separation claw strongly presses against the surface of the fixing roller, thereby causing damage to the surface of the fixing roller or damage to the peeling claw.

Accordingly, the present invention has been devised in consideration of the foregoing conventional problems, and it is an object thereof to provide a fixing device and an image forming apparatus including the same in which the peeling claw can be reliably retracted from the surface of the fixing roller during a jam.

SUMMARY OF THE INVENTION

In order to address these issues, a fixing device according to the present invention is provided with a fixing roller, a peeling claw that peels a recording paper from the fixing roller, a peeling claw holder that rotatably supports the peeling claw, and a support member that movably supports the peeling claw holder to enable the peeling claw to retract by moving apart from the fixing roller, wherein not less than two directions are set as retracting directions of the peeling claw holder to be moved when the peeling claw is caused to retract by moving apart from the fixing roller.

With the present invention, the peeling claw holder is movably supported in two or more directions (for example, two directions or a range contained between the two directions) so that the peeling claw retracts by moving apart from the fixing roller, and therefore when the peeling claw or the peeling claw holder is pressed by a blocked paper, the peeling claw holder can readily move in two or more directions (two directions or a wide range), and the peeling claw reliably retracts from the fixing roller, thus enabling a situation to be avoided in which the claw tip of the peeling claw strongly presses against the surface of the fixing roller.

Furthermore, in the fixing device according to the present invention, the peeling claw holder may be provided with a pin that supports the peeling claw, the support member may be provided with a guide groove that guides the pin, and the peeling claw holder may be movably supported in the support member by the pin.

Due to the guide groove of the support member, when the peeling claw retracts by moving apart from the fixing roller, the peeling claw holder can be guided in two or more directions.

For example, an edge of the guide groove may be provided with opposing portions that are not parallel, and the peeling claw holder may be caused to move in the retracting directions by the pin being guided along the opposing portions.

Furthermore, the fixing device according to the present invention may be provided with a spring that applies a biasing force to the peeling claw holder in a direction in which a claw tip of the peeling claw approaches the fixing roller.

In this way, the tip of the peeling claw is positioned approaching the surface of the fixing roller.

Furthermore, to address the above-described issues, an image forming apparatus according to the present invention is provided with a fixing device according to the present invention described above. Thus, an operation and effect is achieved equivalent to the fixing device according to the present invention.

DESCRIPTION OF EMBODIMENTS

Hereinafter, embodiments of the present invention are described in detail with reference to the accompanying drawings.

Figure 1:
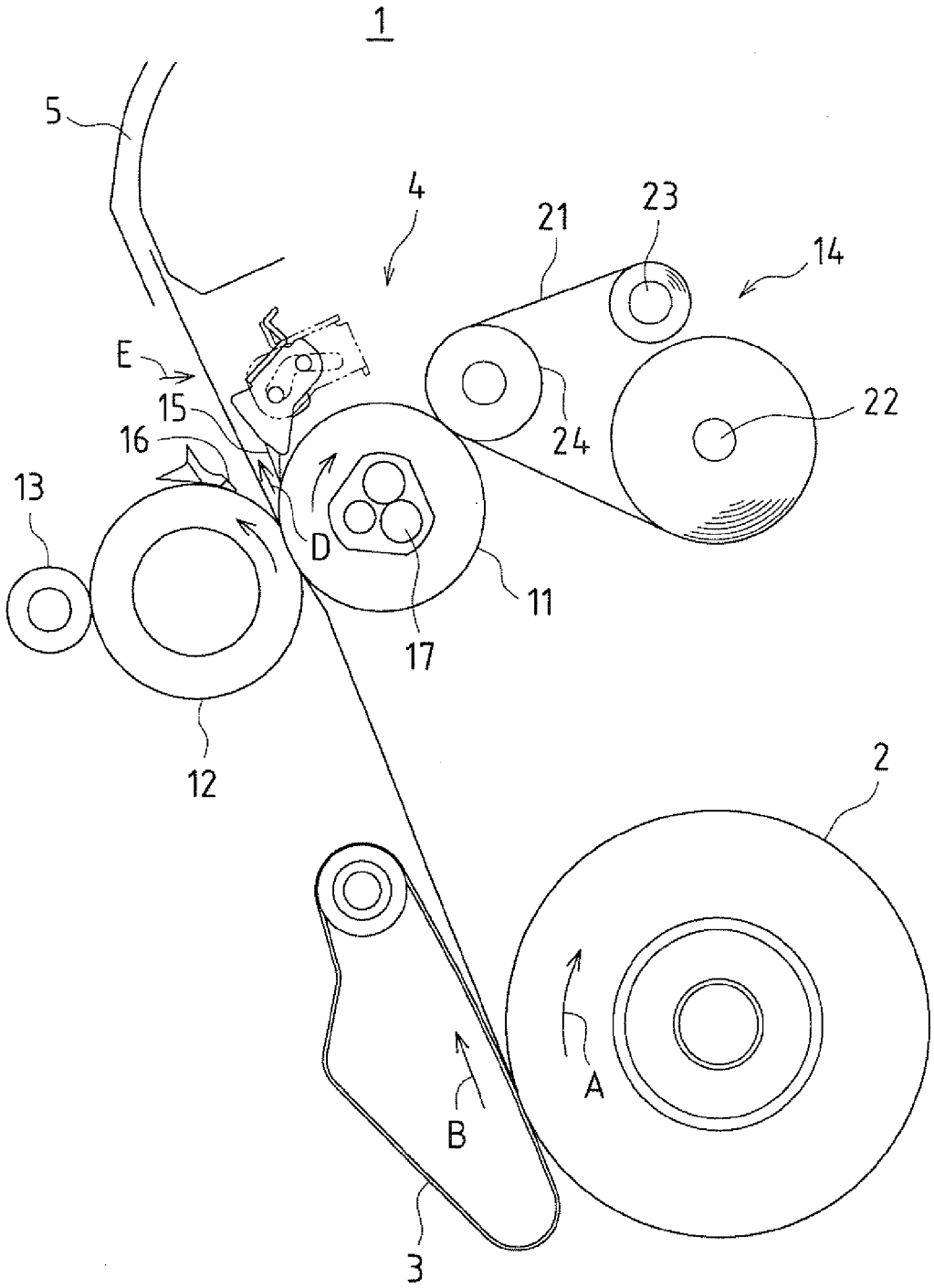
FIG. 1 is a cross-sectional view showing an enlargement of principal portions of an image forming apparatus in which one embodiment of a fixing device according to the present invention has been applied.

FIG. 1 is a cross-sectional view showing an enlargement of principal portions of an image forming apparatus in which one embodiment of a fixing device according to the present invention has been applied.

This image forming apparatus 1 is based on an electrographic method and is provided with components such as a photosensitive drum 2, a transfer belt 3, and a fixing device 4. The photosensitive drum 2 has a photosensitive layer on its surface and is rotationally driven in the direction of arrow A at a constant rotational velocity. Accompanying rotation of the photosensitive drum 2, the surface of the photosensitive drum 2 is charged uniformly to a predetermined electric potential by a charging device (not shown in drawings), an electrostatic latent image is formed on the surface of the photosensitive drum 2 by an exposure device (not shown in drawings), and the electrostatic latent image on the surface of the photosensitive drum 2 is developed into a toner image by a development device (not shown in drawings).

The transfer belt 3 is driven in the direction of arrow B at the same velocity as the surface velocity of the photosensitive drum 2 and presses against the photosensitive drum 2 so that a nip region forms therebetween. A paper that is transported in from there-below is introduced to the nip region, and a toner image on the surface of the photosensitive drum 2 is transferred onto the paper while the paper is transported in the nip region. A high voltage transfer bias (a high voltage (+) that has opposite polarity to the charge polarity (−) of the toner) is applied to the transfer belt 3 to achieve transfer of the toner image.

The paper is transported upward from the photosensitive drum 2 (downstream in the transport direction) and guided to the fixing device 4. The fixing device 4 is provided with a pair of fixing rollers, and this pair of fixing rollers is constituted by a heating roller 11 and a pressure roller 12. The heating roller 11 and the pressure roller 12 press against each other to form a nip region therebetween, and one of these is rotationally driven and the other idly rotates. The paper that is transported from upstream in the transport direction is sandwiched by the heating roller 11 and the pressure roller 12 and subjected to heat and pressure in the nip region between the heating roller 11 and the pressure roller 12, thereby fixing the toner image onto the paper.

This paper is transported further upward through a transport route 5 and discharged into a discharge tray (not shown in drawings) or the like.

In addition to the heating roller 11 and the pressure roller 12, the fixing device 4 according to the present embodiment is provided with components such as an external heating roller 13 that heats the pressure roller 12, a cleaning device 14 for removing toner that has adhered to the surface of the heating roller 11, and peeling claws 15 and 16, which are arranged near the surfaces of and correspond to the heating roller 11 and the pressure roller 12 respectively.

The heating roller 11 includes an inbuilt heater 17 and is heated by this inbuilt heater 17. The surface of the pressure roller 12 is heated by the external heating roller 13.

Furthermore, the heating roller 11 and the pressure roller 12 are rollers having a three-layer construction and are constituted by a core of a metal such as iron, stainless steel, aluminum, or copper or an alloy of any of these, an elastic layer of a silicone rubber or the like on a surface of the core, and further still a mold release layer thereon of PFA or PTFE or the like.

The cleaning device 14 is provided with a feed-out roller 22 onto which is wound a thin web sheet 21 permeated with an oil (silicone oil) or the like, a take-up roller 23 to which the leading edge of the web sheet 21 is connected, and a pressing roller 24 that presses the web sheet 21 between the feed-out roller 22 and the take-up roller 23 onto the heating roller 11, and residual toner adhering to the surface of the heating roller 11 is wiped off and removed by the web sheet 21 being pressed against the surface of the heating roller 11 by the pressing roller 24. Furthermore, the feed-out roller 22 and the take-up roller 23 are intermittently rotated by a fixed amount so that the web sheet 21 is fed out and taken up by the fixed amount, thereby renewing the portion of that web sheet 21 that presses against the surface of the heating roller 11.

The tips of the peeling claws 15 and 16 contact the surface of the heating roller 11 and the surface of the pressure roller 12 respectively, and peel off from the heating roller 11 or the pressure roller 12 any paper that has wound onto the heating roller 11 or the pressure roller 12.

Here, suppose a paper blockage (jam) occurs in the vicinity of the peeling claw 15 (or 16) and the paper stacks up so that the surface of the heating roller 11 (or the pressure roller 12) becomes damaged or the peeling claw 15 (or 16) becomes damaged when the peeling claw 15 (or 16) is strongly pressed against the surface of the heating roller 11 (or the pressure roller 12) by the paper.

In particular, since papers tend to wind onto the heating roller 11 since it contacts the surface of the paper on which the toner image is transferred, the occurrence of such a situation is a matter of concern.

Accordingly, to address these problems, the present embodiment is provided with a configuration in which the peeling claw 15 is movably supported so that the peeling claw 15 on the heating roller 11 side retracts by moving apart from the heating roller 11, thereby reliably avoiding a situation in which the tip of the peeling claw 15 (see claw tip 15*a* below) strongly presses against the surface of the heating roller 11 during the occurrence of a jam.

Next, detailed description is given regarding a support structure of the peeling claw 15 that is capable of retracting by moving apart from the heating roller 11 by way of a peeling claw holder 31 (see below).

Figure 2:
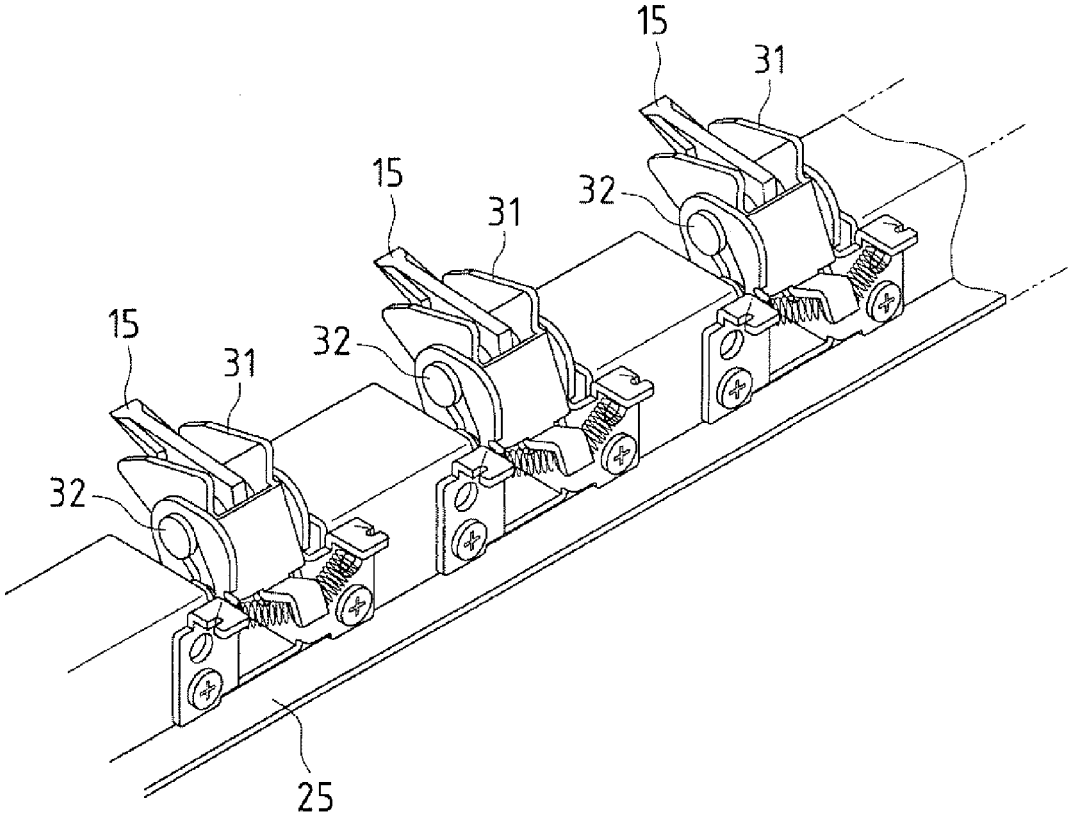
FIG. 2 is a perspective view showing multiple peeling claws and a support frame in a fixing device according to the present embodiment.

FIG. 2 shows multiple peeling claws 15 arranged in a row. In FIG. 2, a support frame 25 is provided along the heating roller 11 (specifically, along the rotational axis direction of the heating roller 11), and multiple peeling claws 15 are arranged on the support frame 25 along the rotational axis direction of the heating roller 11 with fixed intervals therebetween. The claw tips 15*a* of the peeling claws 15 contact the surface of the heating roller 11, and are supported in a movable state so as to approach the heating roller 11 or retract by moving apart from the heating roller 11.

Figure 3:
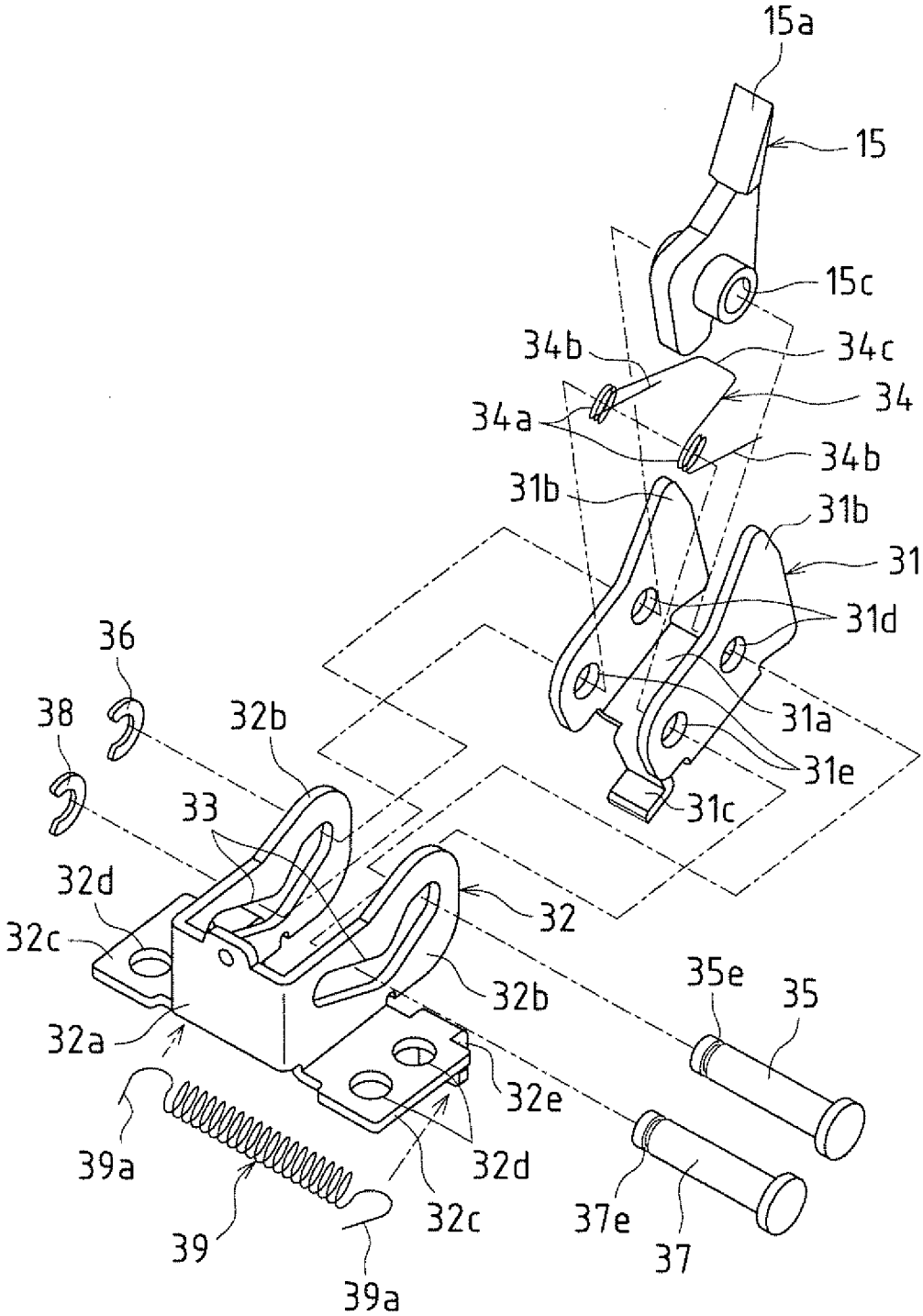
FIG. 3 is an exploded perspective view showing a support structure of a peeling claw.
Figure 4A:
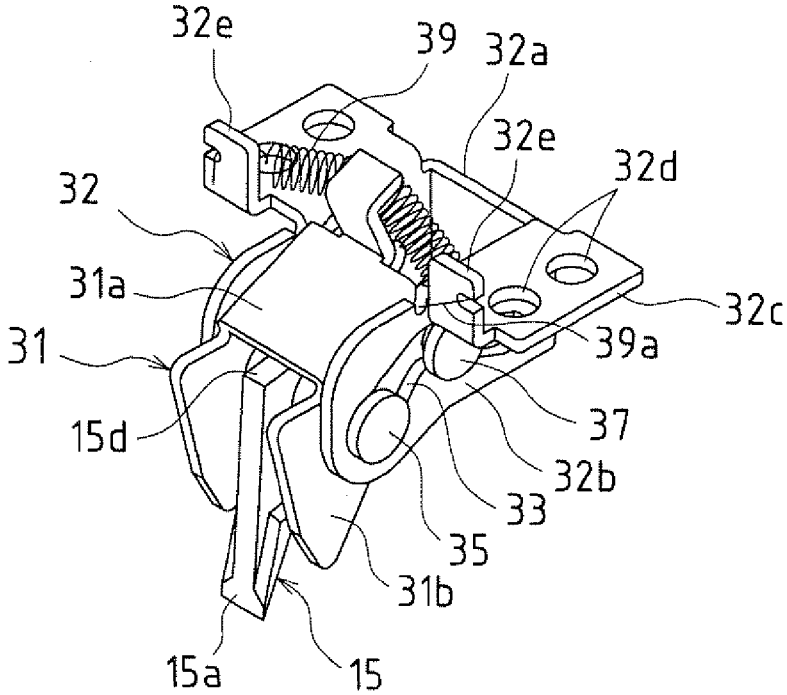
FIG. 4 is constituted by FIG. 4A and FIG. 4B, which are perspective views showing the support structure of the peeling claw as viewed from above and below respectively.
Figure 4B:
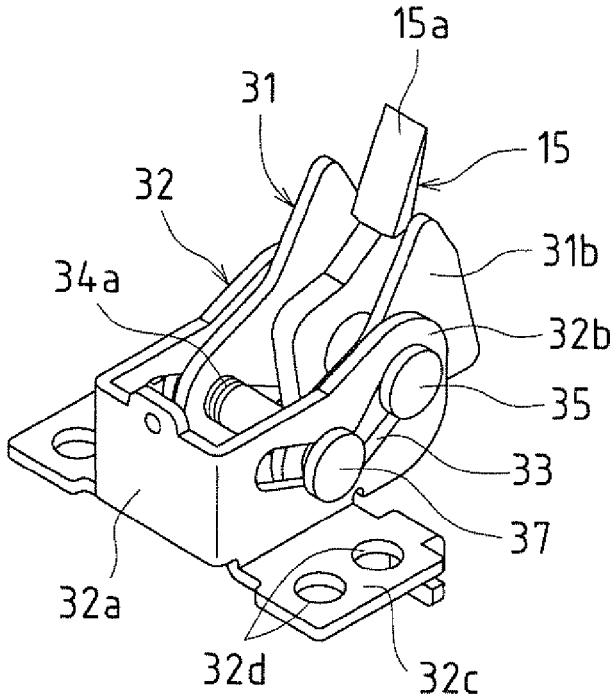
Figure 5A:
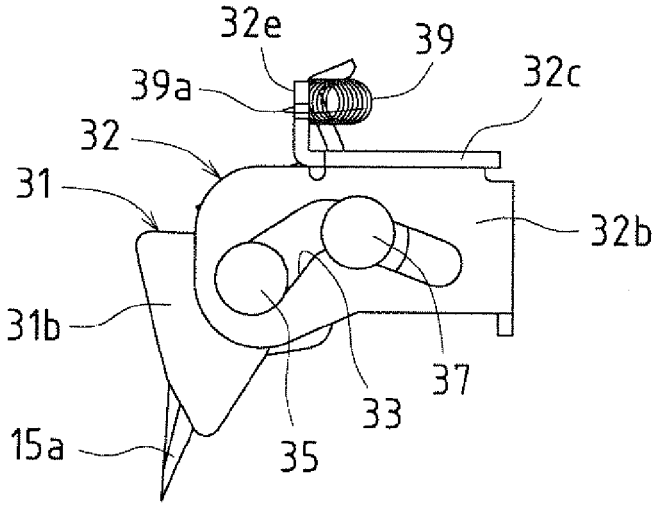
FIG. 5 is constituted by FIG. 5A, FIG. 5B, and FIG. 5C, which are a lateral view, a top view, and a front view showing the support structure of the peeling claw.
Figure 5B:
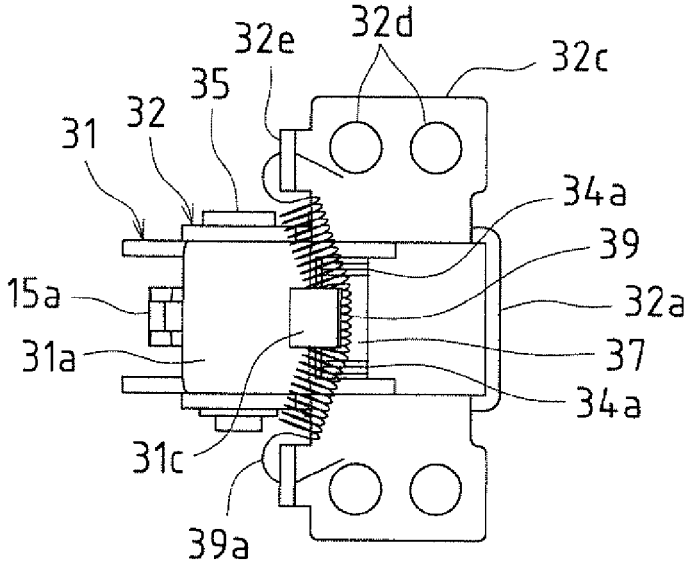
Figure 5C:
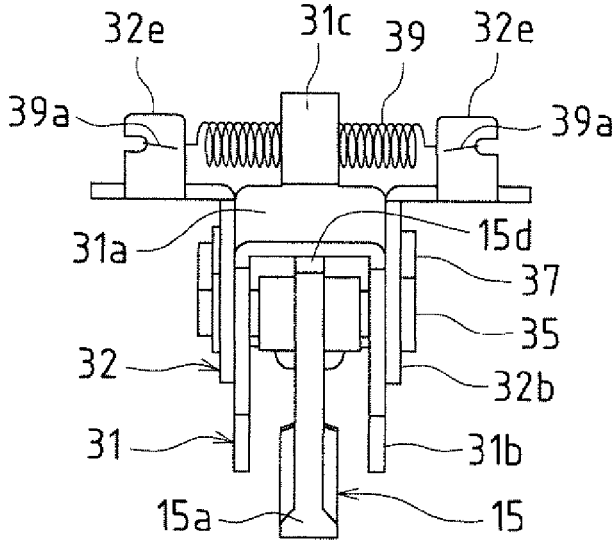

FIG. 3 is an exploded perspective view showing the support structure of the peeling claw 15. FIG. 4A and FIG. 4B are perspective views showing the support structure of the peeling claw 15 as viewed from above and below respectively. FIG. 5A, FIG. 5B, and FIG. 5C are a lateral view, a top view, and a front view showing the support structure of the peeling claw 15.

As shown in FIGS. 3 to 5, the peeling claw 15 is supported at an inner side of the peeling claw holder 31, and the peeling claw holder 31 is supported at an inner side of a support casing 32 (referred to as a "support member" in the present invention).

The peeling claw 15 is provided with the claw tip 15*a*, and a shaft hole 15*c* is formed in a substantially central location of the peeling claw 15. Furthermore, the peeling claw holder 31 is provided with a main panel 31*a*, side panels 31*b* that are bent on either side of the main panel 31*a*, and a hook 31*c* that protrudes from an end portion of the main panel 31*a*, and a pair of shaft holes 31*d* and 31*e* are formed in each of the side panels 31*b*. The peeling claw 15 is arranged on the inner side of the peeling claw holder 31 so as to be covered by the main panel 31*a* and the pair of side panels 31*b* of the peeling claw holder 31.

The support casing 32 is provided with a main panel 32*a*, side panels 32*b* that are bent on either side of the main panel 32*a*, and securing panels 32*c* that are bent from one lateral side of the side panels 32*b* (from a side on one side that is perpendicular to a bent location (bending line) of the side panel 32*b*) to a direction opposite from the other side panel 32*b*. A guide groove 33 is formed in each of the side panels 32*b*. Two perforations 32*d* are formed in each of the securing panels 32*c*, and engaging portions 32*e* are provided that bend from end portions of the securing panels 32*c* (from end portions on the side of one side perpendicular to the bent location (bending line) of the securing panels 32*c*). The peeling claw holder 31 is arranged on the inner side of the support casing 32 so as to be covered by the main panel 32*a* and the pair of side panels 32*b* of the support casing 32.

As is evident from FIG. 3, the peeling claw holder 31 is arranged at the inner side of the side panels 32*b* of the support casing 32, the side panels 31*b* of the peeling claw holder 31 are overlapped by the side panels 32*b* of the support casing 32, and the pair of shaft holes 31*d* and 31*e* of the side panels 31*b* of the peeling claw holder 31 are overlapped by the guide groove 33 of the side panels 32*b* of the support casing 32.

Furthermore, the peeling claw 15 and a torsion spring 34 are arranged at the inner side of side panels 31*b* of the peeling claw holder 31, the shaft hole 15*c* of the peeling claw 15 is overlapped by the shaft holes 31*d* of the side panels 31*b* of the peeling claw holder 31, and coil portions 34*a* of the torsion spring 34 are overlapped by the shaft holes 31*e* of the side panels 31*b* of the peeling claw holder 31. At this time, two end portions 34*b* of the torsion spring 34 are arranged at outer sides of the main panel 31*a* of the peeling claw holder 31, and a central portion 34*c* of the torsion spring 34 hooks onto one end 15*d* of the peeling claw 15.

And a pin 35 inserts through the guide groove 33 of the side panels 32*b* of the support casing 32, the shaft holes 31*d* of the side panels 31*b* of the peeling claw holder 31, and the shaft hole 15*c* of the peeling claw 15 such that a retaining ring 36 couples to a groove 35*e* at one end of the pin 35. Furthermore, another pin 37 inserts through the guide groove 33 of the side panels 32*b* of the support casing 32, the shaft holes 31*e* of the side panels 31*b* of the peeling claw holder 31, and the coil portions 34*a* of the torsion spring 34 such that a retaining ring 38 couples to a groove 37*e* at one end of the pin 37. In this way, the peeling claw holder 31 is supported at the inner side of the side panels 32*b* of the support casing 32, and the peeling claw 15 and the torsion spring 34 are supported at the inner side of the side panels 31*b* of the peeling claw holder 31. Due to these pins 35 and 37, the peeling claw holder 31 is supported in the guide groove 33 of the support casing 32 so as to be capable of moving in an approaching direction of approaching the heating roller 11, and a retracting direction of retracting by moving apart from the heating roller 11. In relation to movement of the peeling claw holder 31 in the retracting direction of these two directions, the peeling claw holder 31 moves in the retracting direction while the pins 35 and 37 are guided in the guide groove 33. For this reason, the peeling claw 15, which is supported by the peeling claw holder 31, moves in the retracting direction accompanying the peeling claw holder 31. The retracting direction in which the peeling claw holder 31 can move that is referred to in the present embodiment is set to directions between a vertical direction and a horizontal direction, that is, two or more directions, and the peeling claw holder 31 retracts (moves) in these directions accompanying the movement direction of the pin 35 within this range. It should be noted that the claw tip 15*a* of the peeling claw 15 displaces in relation to movement of the pin 35. Specifically, the peeling claw 15 displaces accompanying movement of the pin 35, and on that basis the peeling claw 15 rotates based on the movement direction of the pin 35, which alters according to the edges of the guide groove 33, and the claw tip 15*a* rotationally displaces according to this rotation. Detailed movements of the peeling claw 15 are described later.

Further still, hooks 39*a* at both ends of a coil spring 39 hook onto the engaging portions 32*e* of the securing panels 32*c* of the support casing 32, and a central portion of the coil spring 39 hooks onto the hook 31*c* of the main panel 31*a* of the peeling claw holder 31.

In this manner, the peeling claw 15, the peeling claw holder 31, and the support casing 32 are assembled, the securing panels 32*c* of the support casing 32 are mounted onto the support frame 25 shown in FIG. 2, the securing panels 32*c* are screwed onto the support frame 25 via the four perforations 32*d* using four screws (not shown in drawings), the support casing 32 is secured on the support frame 25, and the peeling claw 15 is provided on the support frame 25.

Figure 6A:
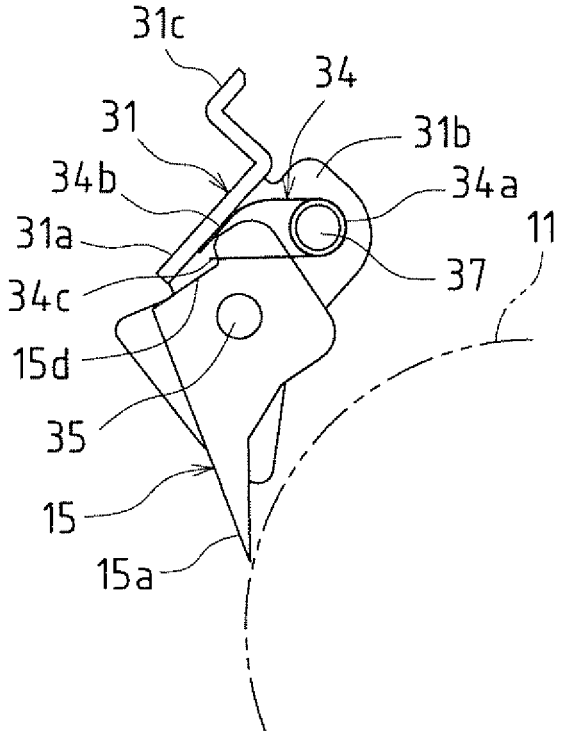
FIG. 6 is constituted by FIG. 6A and FIG. 6B, which are diagrams showing movement of the peeling claw supported by the peeling claw holder.

Next, description is given regarding movement of the peeling claw 15 that is supported by the peeling claw holder 31. As is evident from FIG. 6A, the coil portions 34*a* of the torsion spring 34 are supported through the pin 37, the two end portions 34*b* of the torsion spring 34 press against the main panel 31*a* of the peeling claw holder 31, and the central portion 34*c* of the torsion spring 34 hooks onto the one end 15*d* of the peeling claw 15. In this state, the end portions 34*b* and the central portion 34*c* try to move apart from each other due to the biasing force of the torsion spring 34, and therefore the one end 15*d* of the peeling claw 15 is pushed down by the central portion 34*c* of the torsion spring 34, the peeling claw 15 rotates in the counterclockwise direction around the pin 35, and the claw tip 15*a* of the peeling claw 15 contacts the surface of the heating roller 11. That is, the claw tip 15*a* of the peeling claw 15 is lightly pressed against the surface of the heating roller 11 due to the biasing force of the torsion spring 34.

Figure 6B:
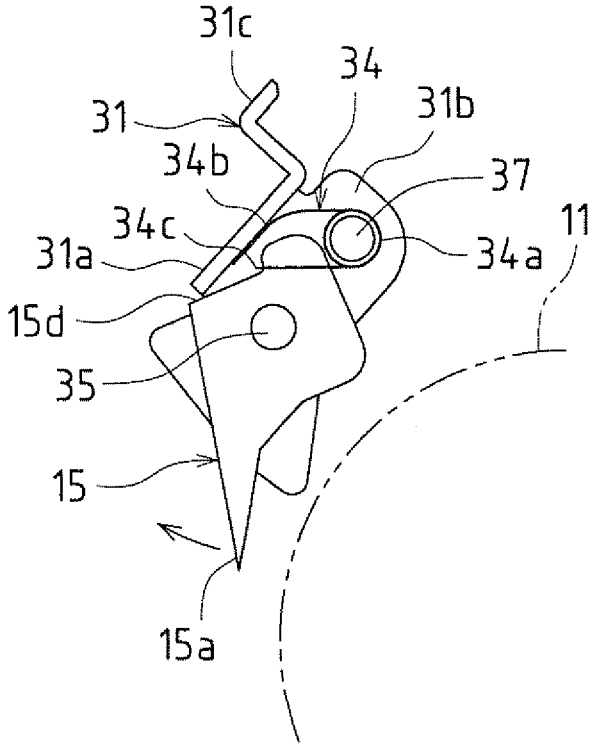

The peeling claw 15 is only biased in the counterclockwise direction by the torsion spring 34, and therefore by causing the peeling claw 15 to rotate in the clockwise direction against the biasing force of the torsion spring 34 as shown in FIG. 6B, it is possible for the peeling claw 15 to move apart from the surface of the heating roller 11.

Next, description is given regarding movement of the peeling claw holder 31 that is supported by the support casing 32 and the peeling claw 15. As is evident also from FIG. 7A, the guide grooves 33 of the side panels 32*b* of the support casing 32 are V-shaped, and are provided with a first guide groove portion 33*a* and a second guide groove portion 33*b*. The first guide groove portion 33*a* guides the pin 35 and the second guide groove portion 33*b* guides the pin 37, and the connection location of the first guide groove portion 33*a* and the second guide groove portion 33*b* is the folding point in the V shape. Since the pins 35 and 37 are inserted through the pairs of shaft holes 31*d* and 31*e* of the side panels 31*b* of the peeling claw holder 31, when the pins 35 and 37 move and are guided by the first and second guide grooves 33*a* and 33*b*, the peeling claw holder 31 and the peeling claw 15 are also guided and move accompanying this. Accordingly, the peeling claw holder 31 and the peeling claw 15 are guided and move in accordance with the first and second guide grooves 33*a* and 33*b*.

The width of the second guide groove portion 33*b* is slightly wider than the diameter of the pin 37, and due to the relationship between the width of the second guide groove portion 33*b* and the diameter of the pin 37, the pin 37 is guided smoothly by the second guide groove portion 33*b*. Furthermore, the second guide groove portion 33*b* is substantially a straight line in shape (formed as an aperture having a substantially straight line shape), and the pin 37 is guided in a straight line by the second guide groove portion 33*b*.

Except for its front end, the width of the first guide groove portion 33*a* is amply wider on its front end side than the diameter of the pin 35, and gradually becomes narrower from the front end side toward its anchoring end side, which is on the second guide groove portion 33*b* side, and is equivalent to the width of the second guide groove portion 33*b* at its anchoring end, which is the connection location with the second guide groove portion 33*b*. The pin 35 has the same diameter as the pin 37, and the width of the first guide groove portion 33*a* is slight wider than the pin 37 at the connection location with the second guide groove portion 33*b*.

Furthermore, a circular arc edge 33*c* that delineates a same arc as the outer circumference of the pin 35 is formed at the front end of the first guide groove portion 33*a*, and a vertical direction guide edge 33*d* and a horizontal direction guide edge 33*e* are formed continuing on from the circular arc edge 33*c*. The first guide groove portion 33*a* is constituted by the circular arc edge 33*c*, the vertical direction guide edge 33*d*, and the horizontal direction guide edge 33*e*, and the vertical direction guide edge 33*d* and the horizontal direction guide edge 33*e* are opposing portions that are not parallel. It should be noted that the vertical direction guide edge 33*d* includes a first slanted guide edge 33*f* that extends slanting diagonally upward with respect to the vertical direction. Furthermore, the horizontal direction guide edge 33*e* includes a second slanted guide edge 33*g* that extends slanting diagonally upward with respect to the horizontal direction. The ends of the first slanted guide edge 33*f* and the second slanted guide edge 33*g* become the anchoring end of the first guide groove portion 33*a*.

Figure 7A:
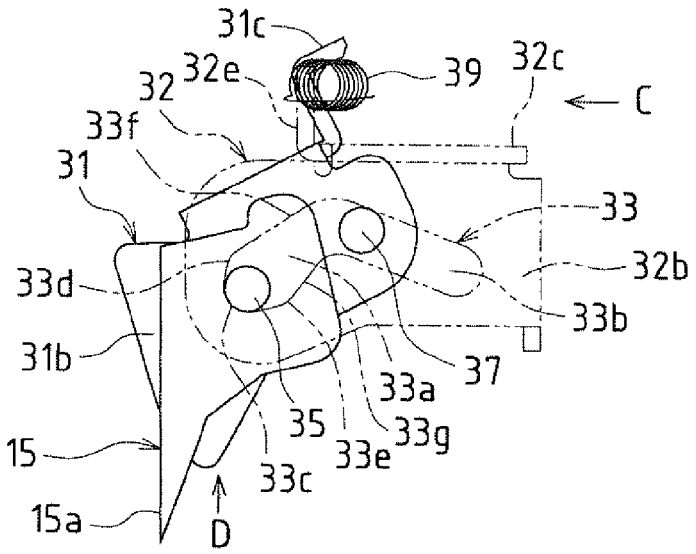
FIG. 7 is constituted by FIG. 7A, FIG. 7B, and FIG. 7C, which are diagrams showing movement of the peeling claw holder supported by the support casing and the peeling claw.

Here, the hooks 39*a* at both ends of a coil spring 39 hook onto the engaging portions 32*e* of the support casing 32, and the central portion of the coil spring 39 hooks onto the hook 31*c* of the peeling claw holder 31, and therefore as shown in FIG. 7A, the peeling claw holder 31 is biased and moves in the direction of arrow C by the coil spring 39, and the pins 35 and 37 also move in the direction of arrow C such that the pin 35 is positioned by contacting the circular arc edge 33*c* of the first guide groove portion 33*a*, and accompanying this, the pin 37 is positioned on the left side of the second guide groove portion 33*b* (the anchoring end of the second guide groove portion 33*b*). At this time, the claw tip 15*a* of the peeling claw 15 is lightly pressed against the surface of the heating roller 11 due to the biasing force of the torsion spring 34 in the same manner as shown in FIG. GA.

Figure 7B:
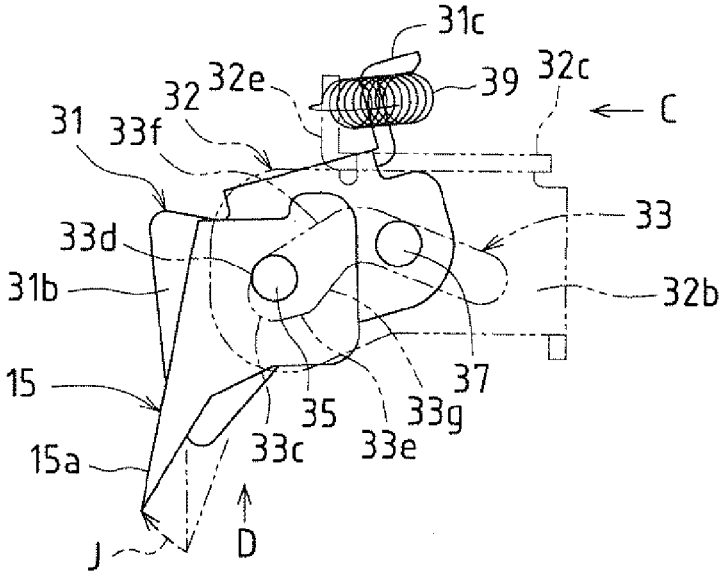
Figure 7C:
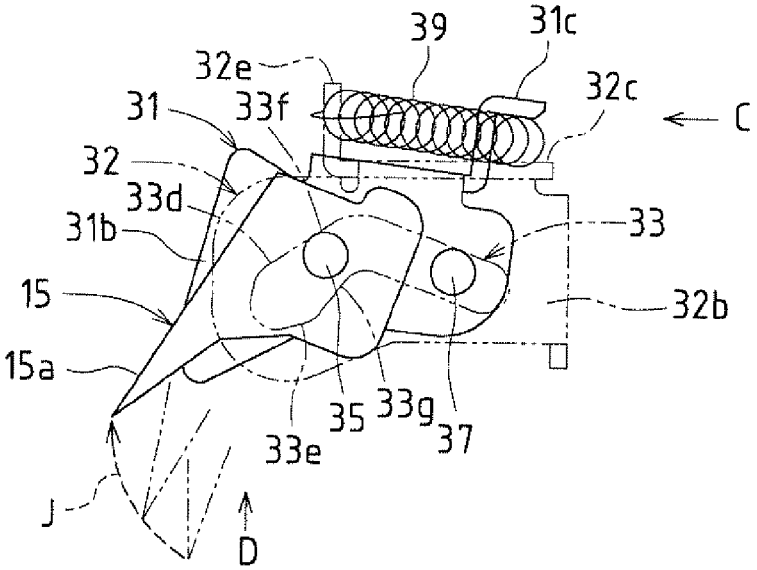

In a case where a vertical direction force of arrow D is applied to the peeling claw holder 31 or the peeling claw 15 in the state shown in FIG. 7A, first the pin 35 moves apart from the circular arc edge 33*c* of the first guide groove portion 33*a* as shown in FIG. 7B and moves in a vertical direction along the vertical direction guide edge 33*d*, after which the pin 35 moves diagonally upward along the first slanted guide edge 33*f* continuing from the vertical portion of the vertical direction guide edge 33*d* as shown in FIG. 7C, and accompanying this the pin 37 moves to the right side of the second guide groove portion 33*b* (away from the anchoring end side of the second guide groove portion 33*b*). At this time, the claw tip 15*a* of the peeling claw 15 moves diagonally upward as shown in FIG. 7B and FIG. 7C to delineate a trajectory J moving apart from the surface of the heating roller 11.

Figure 8A:
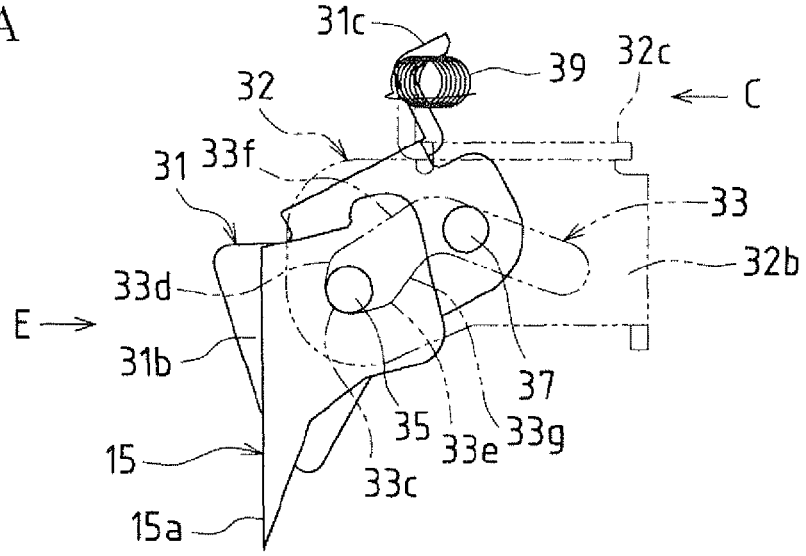
FIG. 8 is constituted by FIG. 8A, FIG. 8B, and FIG. 8C, which are diagrams showing another movement of the peeling claw holder supported by the support casing and the peeling claw.
Figure 8B:
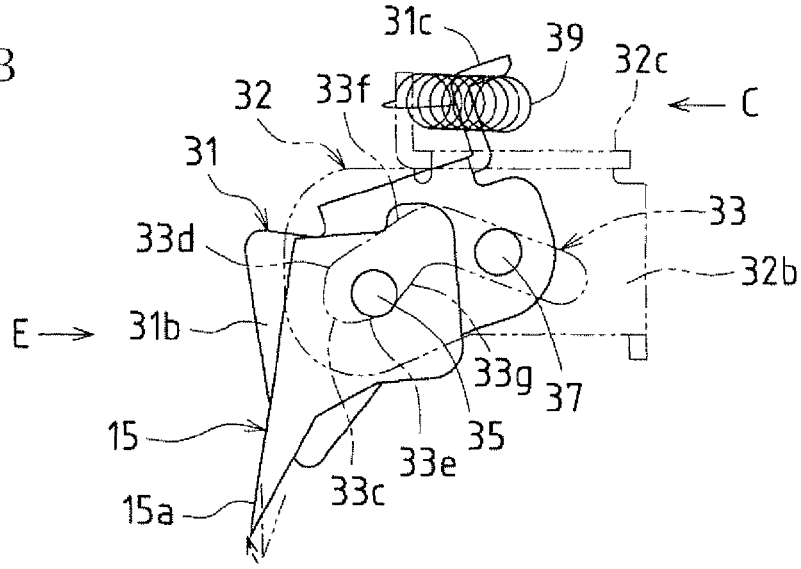
Figure 8C:
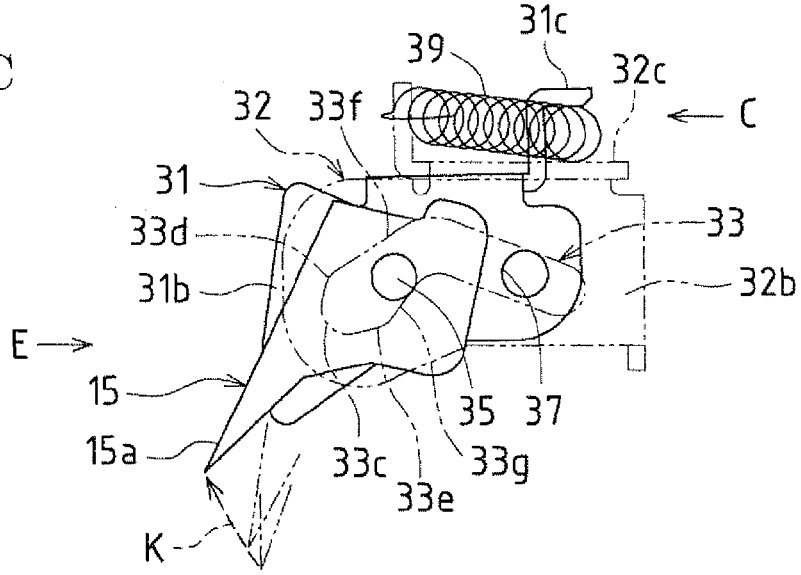

Furthermore, in a case where a horizontal direction force of arrow E is applied to the peeling claw holder 31 or the peeling claw 15 in the state shown in FIG. 8A equivalent to FIG. 7A, that is, in a state in which the pin 35 is positioned by contacting the circular arc edge 33*c* of the first guide groove portion 33*a* and the claw tip 15*a* of the peeling claw 15 is lightly pressed against the surface of the heating roller 11, the pin 35 moves apart from the circular arc edge 33*c* of the first guide groove portion 33*a* as shown in FIG. 8B and moves in a horizontal direction along the horizontal direction guide edge 33*e*, after which the pin 35 moves diagonally upward along the second slanted guide edge 33*g* continuing from the horizontal portion of the horizontal direction guide edge 33*e* as shown in FIG. 8C, and accompanying this the pin 37 moves to the right side of the second guide groove portion 33*b* (away from the anchoring end side of the second guide groove portion 33*b*). At this time, the claw tip 15*a* of the peeling claw 15 moves diagonally upward as shown in FIG. 8B and FIG. 8C (more steeply diagonally upward than shown in FIG. 7B and FIG. 7C) to delineate a trajectory K moving apart from the surface of the heating roller 11.

Accordingly, when a force of a vertical direction of arrow D or a horizontal direction of arrow E is applied to the peeling claw holder 31 or the peeling claw 15, the peeling claw holder 31 moves in that vertical direction or horizontal direction, and the claw tip 15*a* of the peeling claw 15 retracts from the surface of the heating roller 11 delineating the trajectory J or K.

Further still, when a force of a range contained between the vertical direction of arrow D or the horizontal direction of arrow E is applied to the peeling claw holder 31 or the peeling claw 15, the peeling claw holder 31 moves in a range between the vertical direction or horizontal direction, and the claw tip 15*a* of the peeling claw 15 moves apart from the surface of the heating roller 11 delineating a trajectory between the trajectory J of FIG. 7B and FIG. 7C and the trajectory K of FIG. 8B and FIG. 8C.

That is, when a force of a range from the vertical direction of arrow D to the horizontal direction of arrow E is applied to the peeling claw holder 31 or the peeling claw 15, the peeling claw holder 31 readily moves in the range from the vertical direction to the horizontal direction, and the claw tip 15*a* of the peeling claw 15 retracts from the surface of the heating roller 11.

Here, in FIG. 1, when a paper blockage (jam) occurs in the vicinity of the peeling claw 15 and the paper stacks up, a force of the range from the vertical direction of arrow D to the horizontal direction of arrow E is applied to the peeling claw holder 31 or the peeling claw 15 by the paper. For this reason, when the peeling claw holder 31 or the peeling claw 15 is pushed by the paper, the peeling claw holder 31 readily moves in the range from the vertical direction to the horizontal direction, and the claw tip 15*a* of the peeling claw 15 reliably retracts from the surface of the heating roller 11 such that a situation does not occur in which the claw tip 15*a* strongly presses against the surface of the heating roller 11.

In contrast to this, in a case where the movement trajectory of the holder when the separation claw holder moves along the groove is on a single line and the movement direction of the holder is prescribed to a single direction as is the case conventionally, the holder or the separation claw does not move at all according to the direction of pressing by the paper, and the tip of the separation claw strongly presses against the surface of the fixing roller, thereby sometimes causing damage to the surface of the fixing roller or damage to the peeling claw.

The foregoing described preferable embodiments of the present invention with reference to the accompanying drawings, but the present invention is not limited to these examples. It is evident that a person skilled in the art would be capable of conceiving various modifications and alterations within the scope described by the claims, and naturally all of these are to be interpreted as belonging to the technical scope of the present invention.

For example, to adjust the movement direction of the claw tip 15*a* of the peeling claw 15, the shape of the guide grooves 33 of the side panels 32*b* of the support casing 32 may be altered.

Furthermore, in the foregoing embodiment, the retracting directions of the peeling claw holder 31 were set to directions between the vertical direction and the horizontal direction (including the vertical direction and the horizontal direction), but these are directions corresponding to an arrangement relationship among the peeling claw 15, the peeling claw holder 31, and the heating roller 11, and the shape of the guide groove 33 in the present embodiment, and there is no limitation to this as long as there are two or more retracting directions of the peeling claw holder 31 so that the peeling claw 15 retracts by moving apart from the fixing roller 11. That is, directions other than the retracting directions shown in the present embodiment are possible as long as it is a direction in which the peeling claw 15 moves apart from the heating roller 11 such that the claw tip 15*a* of the peeling claw 15 is caused to move apart away from the heating roller 11. As a specific configuration, the transport direction of the paper (arrow D in the present embodiment) and a direction orthogonal to the transport direction (arrow E in the present embodiment) are possible as retracting directions of the peeling claw holder 31. For example, in a case where there is a form in which the peeling claw 15 and the peeling claw holder 31 and the heating roller 11 are arranged in a row along a 45 degree direction with respect to the horizontal direction and the guide grooves 33 according to the present embodiment are used, the two directions may be directions tilted 45 degrees from the vertical direction and the horizontal direction respectively, and the retracting directions may be directions between these directions.

Furthermore, in the above-described present embodiment, the present invention was applied only to the peeling claw 15 against the heating roller 11, but there is no limitation to this and the present invention may also be applied to the peeling claw 16 against the pressure roller 12, and in this case the peeling claw 16, the peeling claw holder 31, and the support casing 32 according to the present embodiment are assembled to achieve an equivalent effect as the above-described present embodiment. It should be noted that a configuration in which the peeling claw 16, the peeling claw holder 31, and the support casing 32 are assembled is an equivalent configuration as the configuration in which the peeling claw 15, the peeling claw holder 31, and the support casing 32 of the present embodiment are assembled, and therefore illustration thereof is omitted.

What is claimed is:

1. A fixing device, comprising:

a fixing roller, a peeling claw that peels a recording paper from the fixing roller, a peeling claw holder that rotatably supports the peeling claw, and a support member that movably supports the peeling claw holder to enable the peeling claw to retract by moving apart from the fixing roller, wherein not less than two directions are set as retracting directions of the peeling claw holder to be moved when the peeling claw is caused to retract by moving apart from the fixing roller, wherein the peeling claw holder is provided with a pin that supports the peeling claw, the support member is provided with a guide grove that guides the pin, and the peeling claw holder is movably supported in the support member by the pin, and wherein an edge of the guide groove is provided with opposing portions that are not parallel, and the peeling claw holder is caused to move in the retracting directions by the pin being guided along the opposing portions.

2. The fixing device according to claim 1, further comprising a spring that applies a biasing force to the peeling claw holder in a direction in which a claw tip of the peeling claw approaches the fixing roller.

3. An image forming apparatus, comprising: a fixing device according to claim 1.

* * * * *